US008561700B1

(12) United States Patent
Barbee, Jr.

(10) Patent No.: US 8,561,700 B1
(45) **Date of Patent: *Oct. 22, 2013**

(54) METHOD AND APPARATUS FOR CEMENTING WHILE RUNNING CASING IN A WELL BORE

(76) Inventor: John Phillip Barbee, Jr., Gretna, LA (US)

( * ) Notice: Subject to any disclaimer, the term of this patent is extended or adjusted under 35 U.S.C. 154(b) by 554 days.

This patent is subject to a terminal disclaimer.

(21) Appl. No.: 12/785,017

(22) Filed: May 21, 2010

Related U.S. Application Data

(60) Provisional application No. 61/180,296, filed on May 21, 2009.

(51) Int. Cl.
*E21B 33/16* (2006.01)
*E21B 33/068* (2006.01)

(52) U.S. Cl.
USPC ..... 166/285; 166/75.15

(58) Field of Classification Search
USPC ..... 166/285, 153, 281, 291, 75.15
See application file for complete search history.

(56) References Cited

U.S. PATENT DOCUMENTS

| | | | | |
|---|---|---|---|---|
| 3,828,852 | A | 8/1974 | Delano | |
| 4,427,065 | A | 1/1984 | Watson | |
| 4,624,312 | A | 11/1986 | McMullin | |
| 4,671,353 | A | 6/1987 | Daming | |
| 4,722,389 | A | 2/1988 | Arnold | |
| 4,782,894 | A | 11/1988 | LaFleur | |
| 4,854,383 | A | 8/1989 | Arnold et al. | |
| 4,995,457 | A | 2/1991 | Baldridge | |
| 5,095,988 | A | 3/1992 | Bode | |
| 5,236,035 | A | 8/1993 | Brisco et al. | |
| 5,293,933 | A | 3/1994 | Brisco | |
| 5,435,390 | A | 7/1995 | Baugh et al. | |
| 5,758,726 | A | 6/1998 | Streich et al. | |
| 5,833,002 | A | 11/1998 | Holcombe | |
| 5,856,790 | A | 1/1999 | Baugh et al. | |
| 5,960,881 | A | 10/1999 | Allamon et al. | |
| 6,142,226 | A | 11/2000 | Vick | |
| 6,182,752 | B1 | 2/2001 | Smith, Jr. et al. | |
| 6,390,200 | B1 | 5/2002 | Allamon et al. | |
| 6,575,238 | B1 | 6/2003 | Yokley | |
| 6,672,384 | B2 | 1/2004 | Pedersen et al. | |
| 6,904,970 | B2 | 6/2005 | Simson | |
| 7,055,611 | B2 * | 6/2006 | Pedersen et al. | 166/386 |
| 7,066,249 | B2 | 6/2006 | Simson | |
| 7,841,410 | B2 * | 11/2010 | Barbee | 166/291 |

* cited by examiner

*Primary Examiner* — Daniel P Stephenson
*Assistant Examiner* — Wei Wang
(74) *Attorney, Agent, or Firm* — Garvey, Smith, Nehrbass & North, L.L.C.; Charles C. Garvey, Jr.; Vanessa M. D'Souza

(57) ABSTRACT

An improved method and apparatus for dropping a ball, plug or dart during oil and gas well operations (e.g., cementing operations) employs a specially configured valving member with curved and flat portions that alternatively direct fluid flow through a bore or opening in the valving member via an inner channel or around the periphery of the valving member in an outer channel. In one embodiment, the ball(s), dart(s) or plug(s) are contained in a sliding sleeve that shifts position responsive to valve rotation. An optional indicator indicates to a user or operator that a ball or plug has passed a selected one of the valving members.

21 Claims, 11 Drawing Sheets

METHOD AND APPARATUS FOR CEMENTING WHILE RUNNING CASING IN A WELL BORE

CROSS-REFERENCE TO RELATED APPLICATIONS

Priority of U.S. Provisional Patent Application Ser. No. 61/180,296, filed 21 May 2009, incorporated herein by reference, is hereby claimed.

U.S. patent application Ser. No. 11/749,591, filed 16 May 2007 (now U.S. Pat. No. 7,607,481), and U.S. patent application Ser. No. 11/951,802, filed 6 Dec. 2007, are each hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus that is of particular utility in cementing operations associated with oil and gas well exploration and production. More specifically the present invention provides an improvement to cementing operations when running a casing string.

2. General Background of the Invention

Patents have issued that relate generally to the concept of using a plug, dart or a ball that is dispensed or dropped into the well or "down hole" during oil and gas well drilling and production operations, especially when conducting cementing operations. The following possibly relevant patents are incorporated herein by reference. The patents are listed numerically. The order of such listing does not have any significance.

TABLE

| U.S. Pat. No. | TITLE | ISSUE DATE MM-DD-YYYY |
|---|---|---|
| 3,828,852 | Apparatus for Cementing Well Bore Casing | Aug. 13, 1974 |
| 4,427,065 | Cementing Plug Container and Method of Use Thereof | Jan. 24, 1984 |
| 4,624,312 | Remote Cementing Plug Launching System | Nov. 25, 1986 |
| 4,671,353 | Apparatus for Releasing a Cementing Plug | Jun. 09, 1987 |
| 4,722,389 | Well Bore Servicing Arrangement | Feb. 02, 1988 |
| 4,782,894 | Cementing Plug Container with Remote Control System | Nov. 08, 1988 |
| 4,854,383 | Manifold Arrangement for use with a Top Drive Power Unit | Aug. 08, 1989 |
| 4,995,457 | Lift-Through Head and Swivel | Feb. 26, 1991 |
| 5,095,988 | Plug Injection Method and Apparatus | Mar. 17, 1992 |
| 5,236,035 | Swivel Cementing Head with Manifold Assembly | Aug. 17, 1993 |
| 5,293,933 | Swivel Cementing Head with Manifold Assembly Having Remove Control Valves and Plug Release Plungers | Mar. 15, 1994 |
| 5,435,390 | Remote Control for a Plug-Dropping Head | Jul. 25, 1995 |
| 5,758,726 | Ball Drop Head With Rotating Rings | Jun. 02, 1998 |
| 5,833,002 | Remote Control Plug-Dropping Head | Nov. 10, 1998 |
| 5,856,790 | Remote Control for a Plug-Dropping Head | Jan. 05, 1999 |
| 5,960,881 | Downhole Surge Pressure Reduction System and Method of Use | Oct. 05, 1999 |
| 6,142,226 | Hydraulic Setting Tool | Nov. 07, 2000 |
| 6,182,752 | Multi-Port Cementing Head | Feb. 06, 2001 |

TABLE-continued

| U.S. Pat. No. | TITLE | ISSUE DATE MM-DD-YYYY |
|---|---|---|
| 6,390,200 | Drop Ball Sub and System of Use | May 21, 2002 |
| 6,575,238 | Ball and Plug Dropping Head | Jun. 10, 2003 |
| 6,672,384 | Plug-Dropping Container for Releasing a Plug Into a Wellbore | Jan. 06, 2004 |
| 6,904,970 | Cementing Manifold Assembly | Jun. 14, 2005 |
| 7,066,249 | Plug-Dropping Container for Releasing a Plug into a Wellbore | Jun. 27, 2006 |

BRIEF SUMMARY OF THE INVENTION

The present invention provides an improved method and apparatus for use in cementing and like operations when running casing.

In one embodiment, the present invention is directed to a method of transmitting cement into an oil and gas well having an open hole well bore at least partially occupied by a casing string, comprising the steps of:

a) providing a top drive casing installation apparatus that is able to lift a joint of casing, rotate that joint of casing to a generally inclined or vertical position and then rotate that joint of casing while connecting that joint of casing to a casing string that extends into the well bore;

b) rotating the casing string with the apparatus of claim 1 after step "a" while circulating a well fluid into the well bore via the casing string annulus;

c) preparing a module that is about the size of the joint of casing of step "a", wherein the module includes a plug dropping tool having one or more valves that enables fluid flow in the casing string below the module to be valved and one or more plugs that can be lowered into the well bore by opening one of the valves;

d) using the top drive casing installation apparatus of step "a" to join the module of step "c" to the casing string;

e) circulating fluid into the well via the module after step "d";

f) releasing a plug from the module of step "c"; and g) transmitting cement into the well bore after step "f".

Preferably, the module includes an extension member below the plug dropping tool. The module can include an extension member above the plug dropping tool.

The method can further comprise dropping a plug from the plug dropping tool after step "g".

The method can provide a mechanism that makes up joints of casing to form the casing string, and in steps "c" through "g" the module is positioned above said mechanism.

The module preferably includes an intake port that enables intake of cement.

The method can include positioning the valves of the module of step "c" below the intake port.

Preferably, there are three of said valves in the module of step "c".

Preferably, there are at least three connectable sections that define the module of step "c".

The present invention provides in one embodiment a method of transmitting cement into an oil and gas well having an open hole well bore with a well annulus that is at least partially occupied by a casing string having a casing annulus, comprising the steps of:

a) providing a top drive casing installation apparatus that is able to lift a joint of casing, rotate that joint of casing to a generally inclined or vertical position and then rotate that joint of casing while connecting that joint of casing to a casing string that extends into a the well bore;

b) rotating the casing string with the apparatus of claim 1 after step "a" while circulating a well fluid into the well bore via the casing string annulus;

c) preparing a module that is about the size of the joint of casing of step "a", wherein the module includes a plug dropping tool having one or more valves that enables fluid flow in the casing string below the module to be valved and one or more plugs that can be lowered into the well bore by opening one of the valves;

d) using the top drive casing installation apparatus of step "a" to join the module of step "c" to the casing string;

e) circulating fluid into the well via the module after step "d";

f) releasing a plug from the module of step "c"; and g) transmitting cement into the well bore after step "f" of sufficient volume to fill at least a portion of the well annulus in between a formation and the casing.

The present invention provides in one embodiment a method of cementing an annular space in between a casing string having a casing string bore and an oil well having a well bore, comprising the steps of:

a) providing a plurality of casing joints that enable the casing string to be lengthened;

b) connecting a casing joint to the string with a machine that both lifts the casing joint and rotates the casing joint and casing string relative to one another during connecting;

c) circulating a fluid into the well bore via the casing bore after step "c";

d) providing a casing joint module having a module wall, module bore and a plug dropping tool, said tool including one or more valves and one or more plugs;

e) after step "b", adding the module of step "d" to the casing string with the machine of step "b"; and f) pumping a volume of cement containing material into the well bore via the plug dropping tool and casing bore, wherein a plug travels from the plug dropping tool to the casing bore with the cement containing material.

Preferably, the module has multiple valves and multiple plugs and further comprising placing plugs upstream and downstream of the volume of cement containing material while the machine of step "b" and "e" is at least partially supporting the module.

Preferably, the machine lifts the module from a non-vertical to a generally vertical position in step "e".

Preferably, in step "e" part of the module extends above the machine.

Preferably, in step "d" the module has a fitting that enables fluid to be pumped into the module bore via the module wall.

Preferably, the casing string is rotated between steps "b" and "f".

Preferably, the casing string is rotated and moved vertically in between steps "b" and "f".

Preferably, the pumping of step "f" occurs less than one hour after step "e".

In one embodiment, the present invention provides a method of cementing an annular space in between a casing string having a casing string bore and an oil well having a well bore, comprising the steps of:

a) providing a plurality of casing joints that enable the casing string to be lengthened;

b) connecting a casing joint to the string with a machine that both lifts the casing joint and rotates the casing joint and casing string relative to one another during connecting;

c) circulating a fluid into the well bore via the casing bore after step "c";

d) providing a casing joint module having a module wall, module bore and a plug dropping tool, said tool including one or more valves and one or more plugs;

e) after step "b", adding the module of step "d" to the casing string with the machine of step "b";

f) pumping a volume of cement containing material into the well bore via the plug dropping tool and casing bore, wherein a plug travels from the plug dropping tool to the casing bore with the cement containing material;

g) wherein the machine remains in substantially the same position in steps "b" through "e".

The module can have multiple valves and multiple plugs and the method can further comprise placing plugs upstream and downstream of the volume of cement containing material while the machine of step "b" and "e" is at least partially supporting the module.

Preferably, the machine lifts the module from a non-vertical to a generally vertical position in step "e".

Preferably, in step "e" part of the module extends above the machine.

Preferably, in step "d" the module has a fitting that enables fluid to be pumped into the module bore via the module wall.

Preferably, the casing string is rotated between steps "b" and "f".

Preferably, the casing string is rotated and moved vertically in between steps "b" and "f".

Preferably, the pumping of step "f" occurs less than one hour after step "e".

In one embodiment, the present invention provides a method of transmitting cement into an oil and gas well having an open hole well bore at least partially occupied by a casing string, comprising the steps of:

a) providing a top drive casing installation apparatus that is able to lift a joint of casing, rotate that joint of casing to a generally inclined or vertical position and then rotate that joint of casing while connecting that joint of casing to a casing string that extends into a the well bore;

b) attaching a valving apparatus to the casing string after step "a" that enables fluid circulation through a valving member or around a valving member that controls dispensing of a plug so that circulation is enabled before or after dropping a plug, the valving apparatus including one or more ball valving members that valve a central passageway and one or more fins attached to the ball valving member for valving flow outside and around the central passageway;

c) rotating the casing string after step "b" while circulating a well fluid into the well bore via the casing string annulus;

d) circulating fluid into the well after step "b";

e) releasing a plug into the well after step "c"; and f) transmitting cement into the well bore after step "e".

Preferably, at least one valving member has a valve opening that enables passage of a plug of a diameter of 6.5 inches.

Preferably, the tool body has a working tension of two million pounds.

Preferably, the tool body has an internal working pressure of 15,000 psi.

Preferably, the tool body has a working torque of 50,000 foot pounds.

Preferably, the tool body has a working torque of 50,000 foot pounds in either of two rotational directions.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
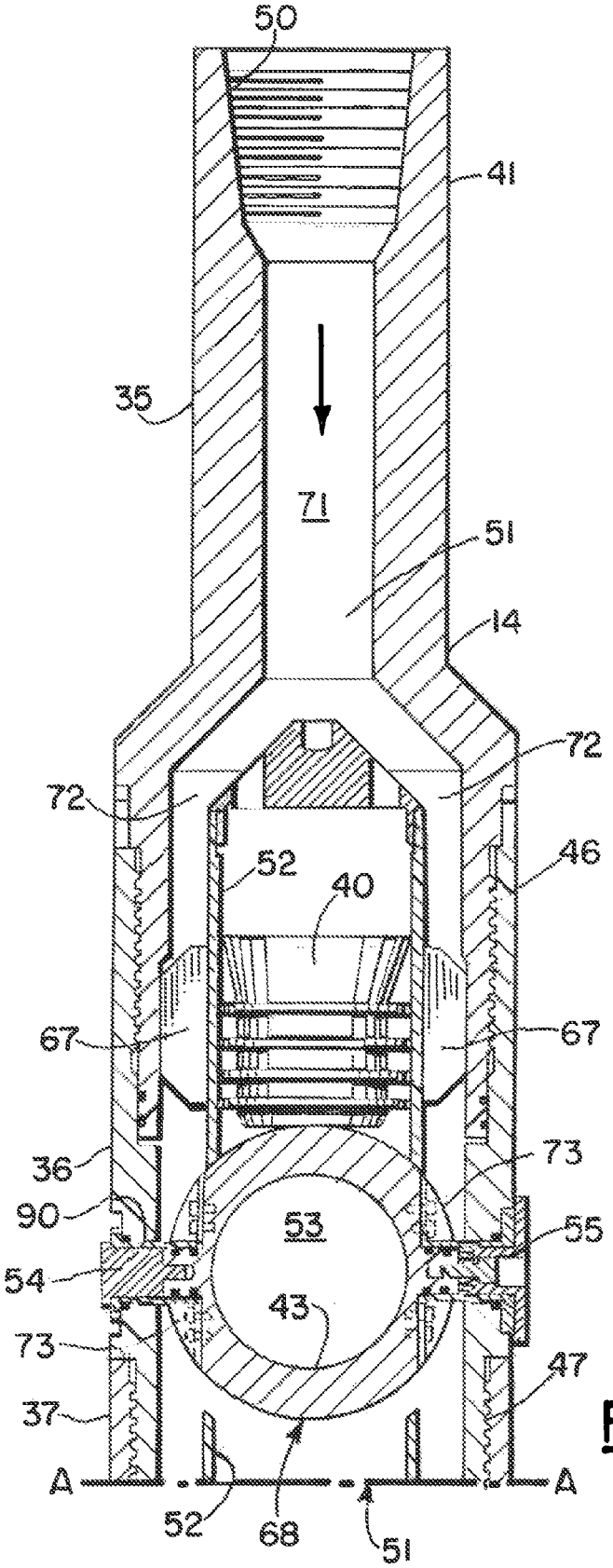
FIGS. 1A, 1B, 1C are partial sectional elevation views of the preferred embodiment of the apparatus of the present invention wherein line A-A of FIG. 1A matches line A-A of FIG. 1B, and line B-B of FIG. 1B matches line B-B of FIG. 1C.

FIGS. 5-9 show generally an oil well drilling system 10 that can provide a platform 11. Such platforms 11 are well known. Platform 11 supports a derrick 12 that can be equipped with a lifting device or draw works 13. Platform 11 can employ a top drive unit. A top drive unit can be seen for example in U.S. Pat. Nos. 4,854,383 and 4,722,389 which are incorporated herein by reference.

Figures 9, 10, 11:
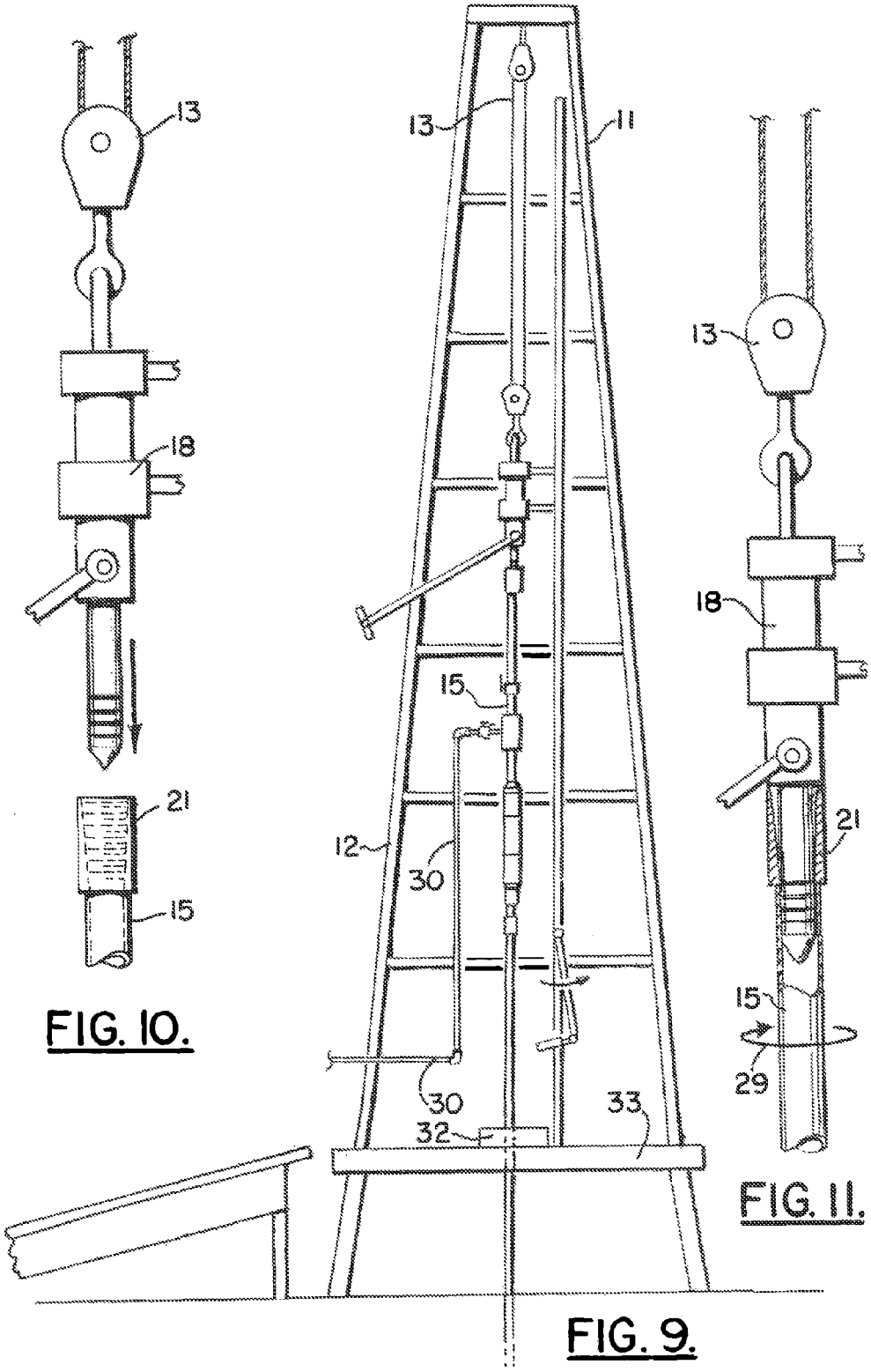
FIG. 9 is a partial elevation view of the preferred embodiment of the apparatus of the present invention and showing part of the method of the present invention.
FIG. 10 is a partial elevation view illustrating part of the method of the present invention.
FIG. 11 is a partial elevation view illustrating part of the method of the present invention.
Figure 12:
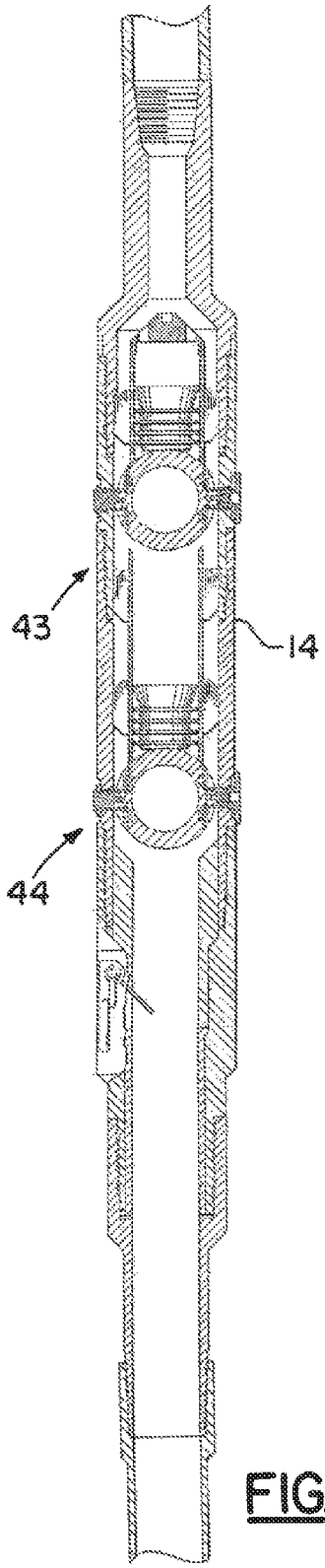
FIG. 12 is a partial sectional elevation view of the preferred embodiment of the apparatus of the present invention.

In FIG. 9, a flow line 30 can be used for providing a selected fluid such as a fluidized cement or fluidized setable material to be pumped into the well during operations which are known in the industry and are sometimes referred to as cementing operations. Such cementing operations are discussed for example in prior U.S. Pat. Nos. 3,828,852; 4,427,065; 4,671,353; 4,782,894; 4,995,457; 5,236,035; 5,293,933; and 6,182,752, each of which is incorporated herein by reference.

Figure 3:
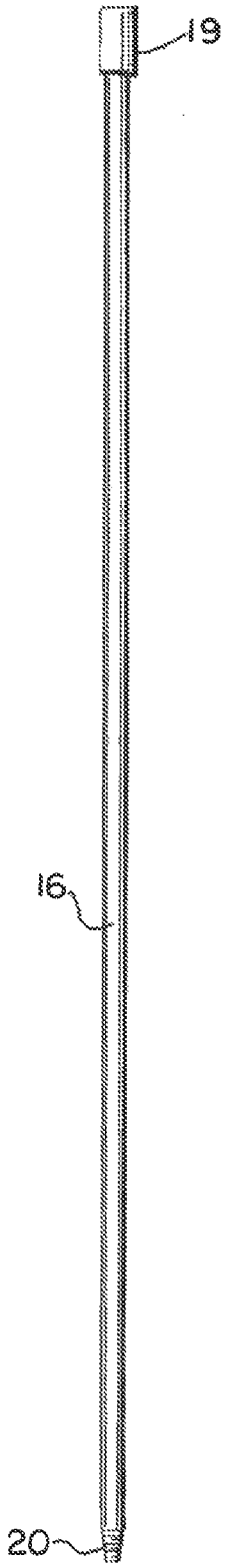
FIG. 3 is an elevation view of a section of casing.

A casing running tool or "CRT" 18 can be used to add joints of casing 16 (see FIG. 3) to a casing string 17 that extends into a well bore. The casing string 17 is comprised of many joints of casing 16 connected end to end, typically with threaded connections. Casing running tool 18 is capable of supporting one joint of casing 16 at a time using arm or arms 31. String 17 is supported with slips 32 when a new joint 16 must be added to string 17 (see FIG. 6, 8).

Platform 11 provides a platform deck 33 that affords space for well personnel to operate and for the storage of equipment and supplies that are needed for the well drilling operation. The installation (or removal) of casing running tool 18 requires about three to four (3-4) hours of labor for platform operators.

Typically, the casing running tool 18 must be removed before a cementing operation can be conducted. Because the removal of the casing running tool 18 occupies about three to four hours of crew time, it is not possible to circulate fluid through the casing string 17 while the casing running tool 18 is being removed. This can lead to an immobilization or sticking of the casing string 17 in the well bore.

When a cementing operation is conducted, it is desirable or necessary to not only rotate the string 17 but to also reciprocate the string 17 up and down relative to the surrounding formation. Failure to do so can result in void spaces and an incomplete or failed cementing operation.

The present invention provides an improved method of installing a casing string and cementing the casing string in position wherein the three to four hours of rig time that are normally lost to the removal of a casing running tool have been eliminated. Thus, the casing string can be continuously rotated as shown by arrow 29, reciprocated and fluid circulated to prevent a sticking of the casing string. This is accomplished by employing a module 15 that is about the same size and length as a normal joint of casing 16. The module 15 is shown in FIGS. 4 and 6-9.

The module 15 includes upper 21 and lower 22 end portions. The module is similar in size to a typical joint of casing 16 (see FIG. 3) which has an upper end portion 19 that can be in the form of a box connection and a lower end portion 20 that can be in the form of a pin connection. In this fashion, the lower or pin connection 20 of one joint of casing 16 connects to the box connection or upper end portion 19 of the joint of casing 16 below it. Similarly, the module 15 provides an upper end portion 21 with a box connection and a lower end portion 22 with a pin connection that enables connection of the module 15 to a joint of casing 16 at its box connection 19.

Figure 4:
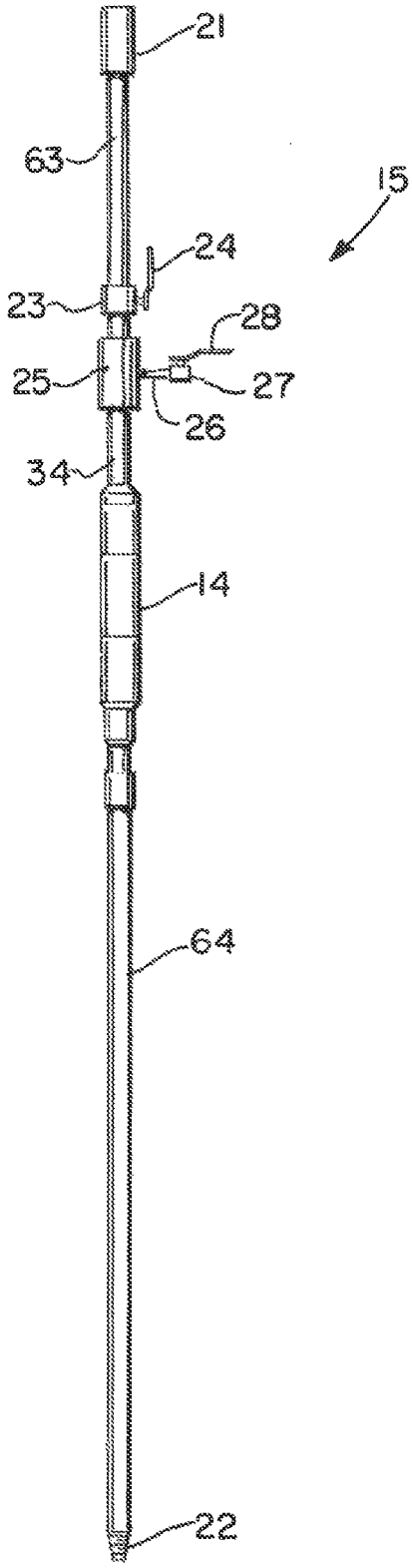
FIG. 4 is a partial elevation view of the preferred embodiment of the apparatus of the present invention.
Figure 5:
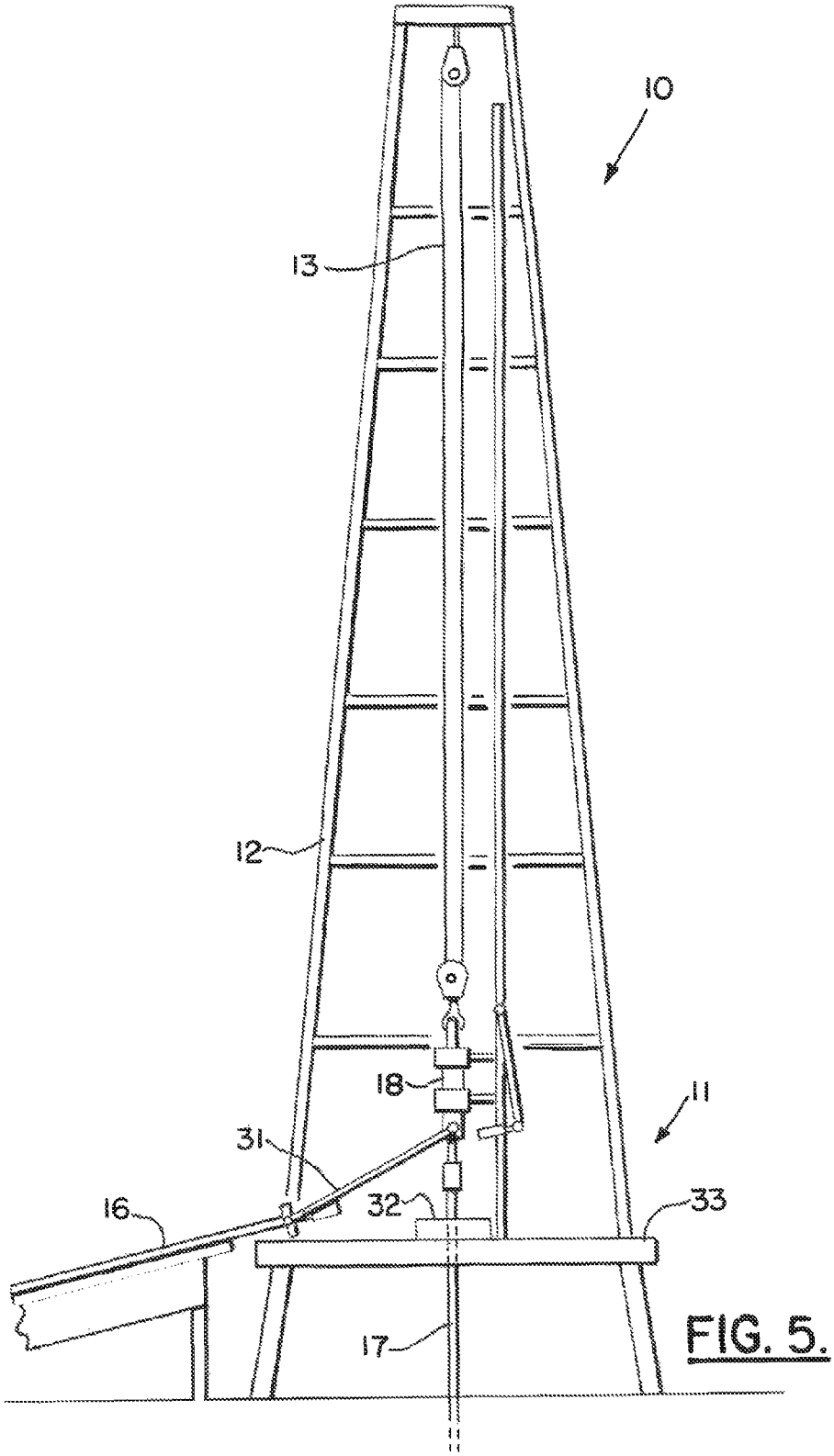
FIG. 5 is a partial elevation view of the preferred embodiment of the apparatus of the present invention and showing part of the method of the present invention.
Figure 6:
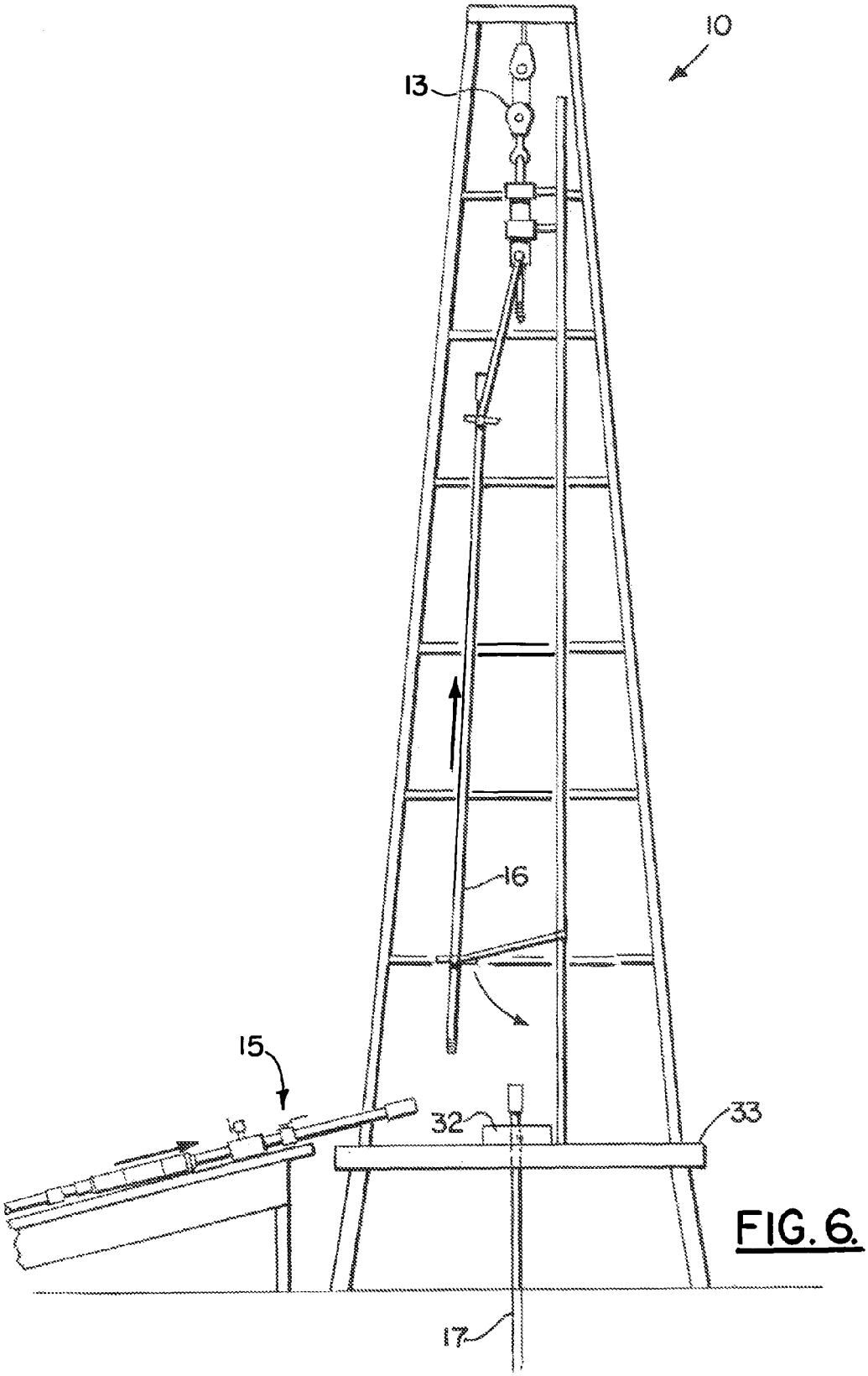
FIG. 6 is a partial elevation view of the preferred embodiment of the apparatus of the present invention and showing part of the method of the present invention.
Figure 7:
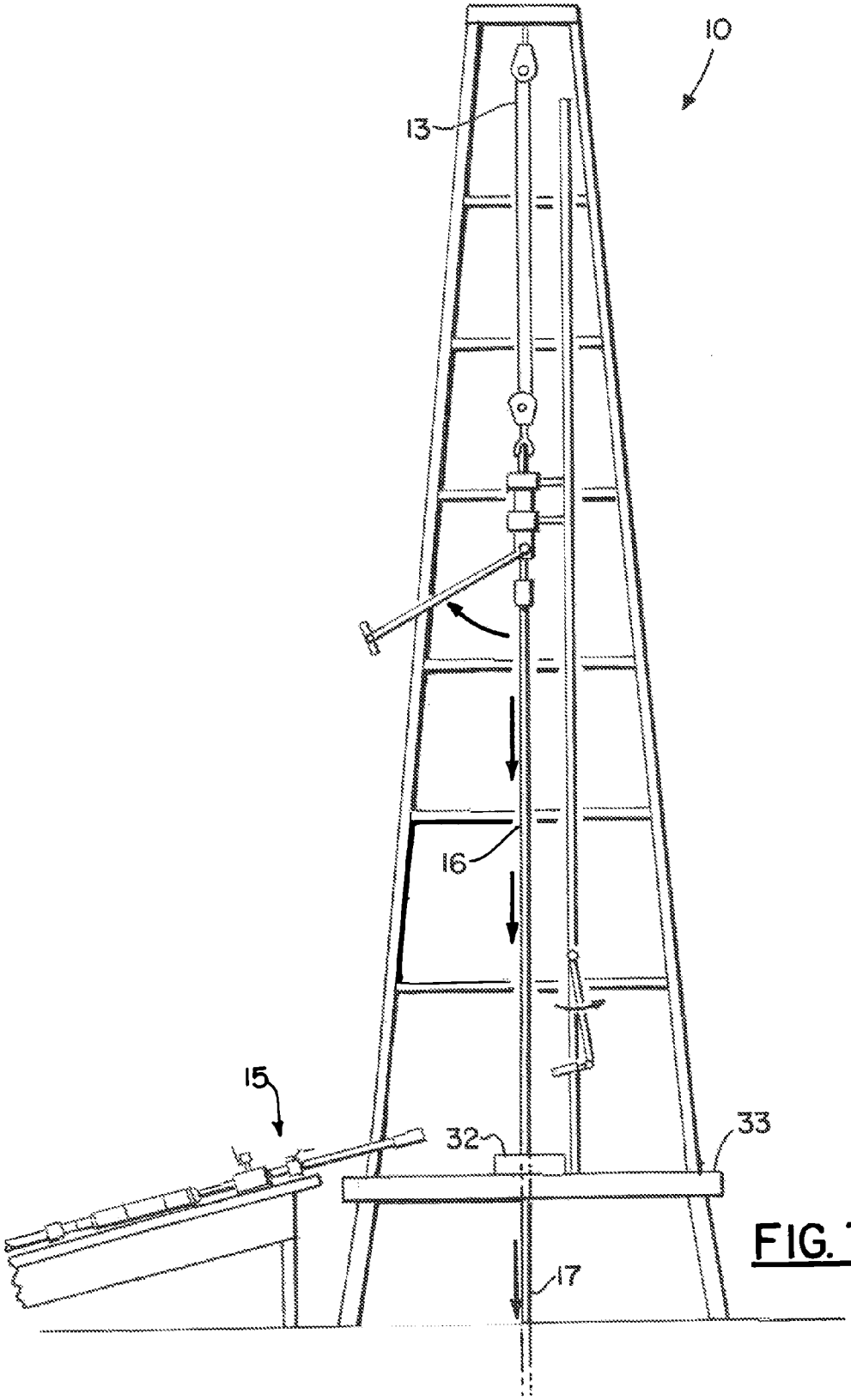
FIG. 7 is a partial elevation view of the preferred embodiment of the apparatus of the present invention and showing part of the method of the present invention.
Figure 8:
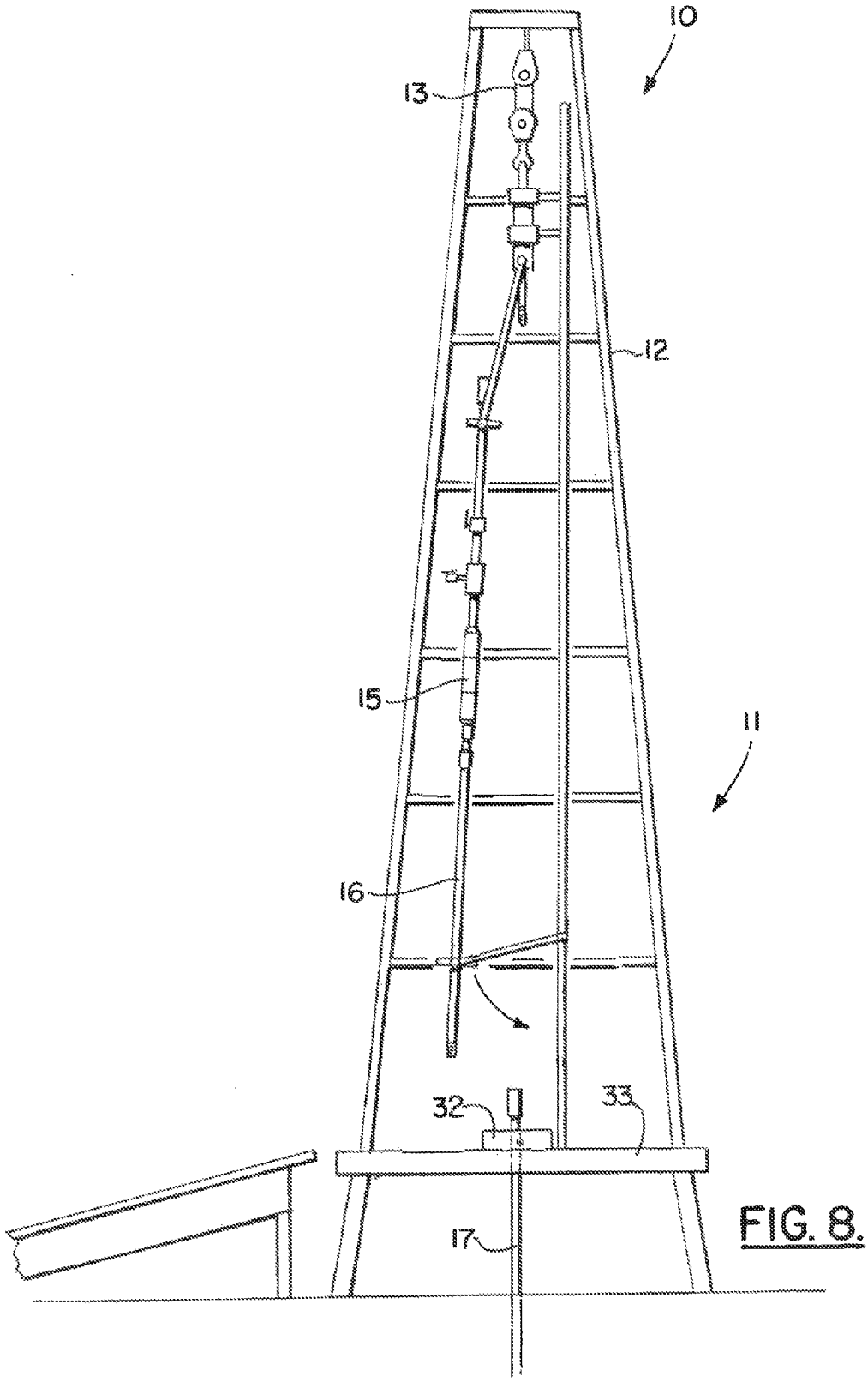
FIG. 8 is a partial elevation view of the preferred embodiment of the apparatus of the present invention and showing part of the method of the present invention.

In FIG. 4, the module 15 includes a tool body 14 that is connected with a short joint of pipe or sub 34 to fitting 25. The fitting 25 is a t-fitting that employs an inlet flow line 26 for adding cement or fluid containing cement to the bore of the module 15. Valve 23 is placed above fitting 25 and provides a valve handle 24 for operating the valve 23. Similarly, the flow line 26 can be provided with a valve 27 having a handle 28 for opening or closing the valve 27.

Above valve 23 is provided another short joint or sub 63 which provides the box connection 21. Below tool body 14 is provided a long joint of pipe or sub 64 having a lower end portion that provides pin connection 22. In comparing FIGS. 3 and 4, the module 15 (FIG. 4) is about the same length (for example, about 40-42 feet) as a standard joint of casing 16 (FIG. 3) and provides the same connections at its end portions 21, 22.

A casing running tool 18 simply handles the module 15 in the same fashion that it handles a joint of casing 16. With the present invention, the casing running tool 18 does not have to be removed for cementing operations. Rather, it simply loads the module 15 into position at the top of string 17 as shown in FIGS. 6, 7, 8 and 9 in the same manner that it loads and installs a joint of casing 16. The casing running tool 18 can then remain in position during cementing operations, its removal not being required. Instead, cementing operations are conducted through the module 15 with its valve and fittings 23-28 and tool body 14.

The present invention provides a tool body 14 configured for dropping balls, plugs, darts or the like as a part of a cementing operation. In the drawings (FIGS. 1A, 1B, 1C, 12-15), arrows 75 indicate generally the flow path of fluid (e.g. cement, fluidized material or the like) through the tool body 14. In that regard, the present invention provides an improved ball or plug or dart dropping tool body 14.

Figure 1B:
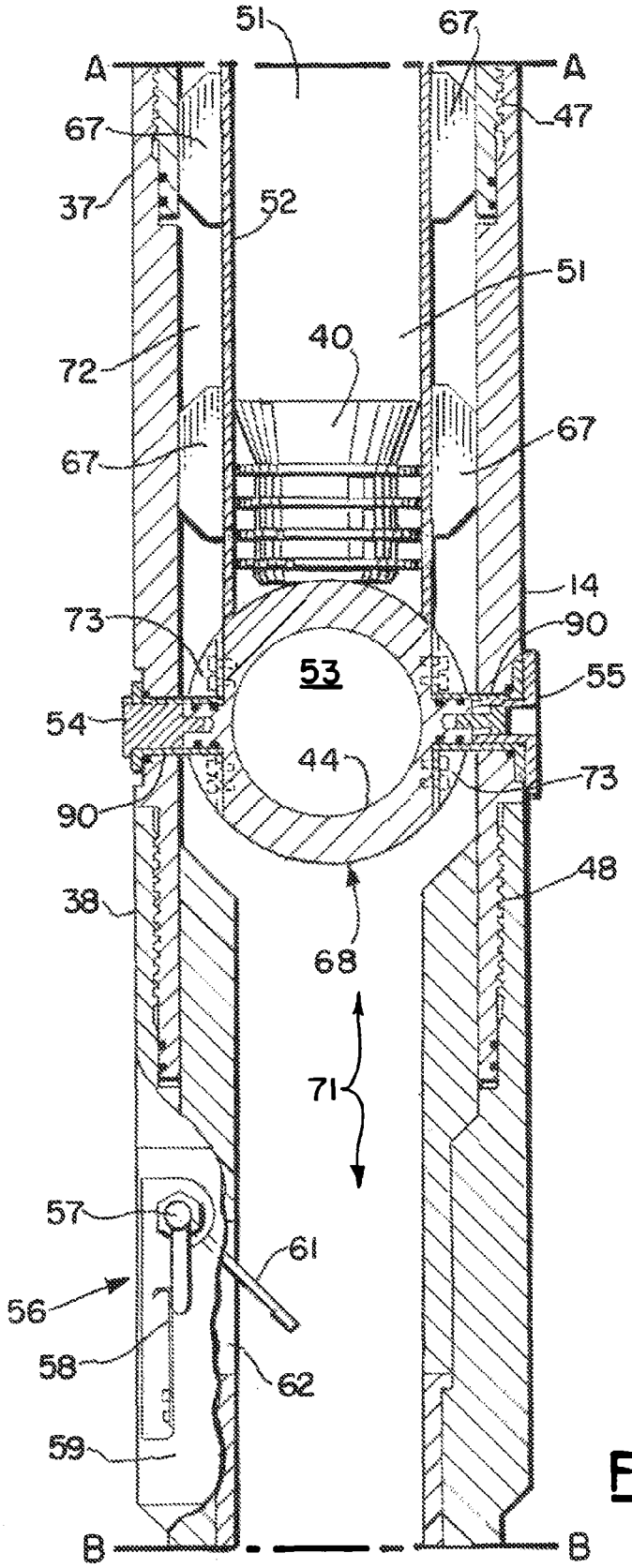
Figure 1C:
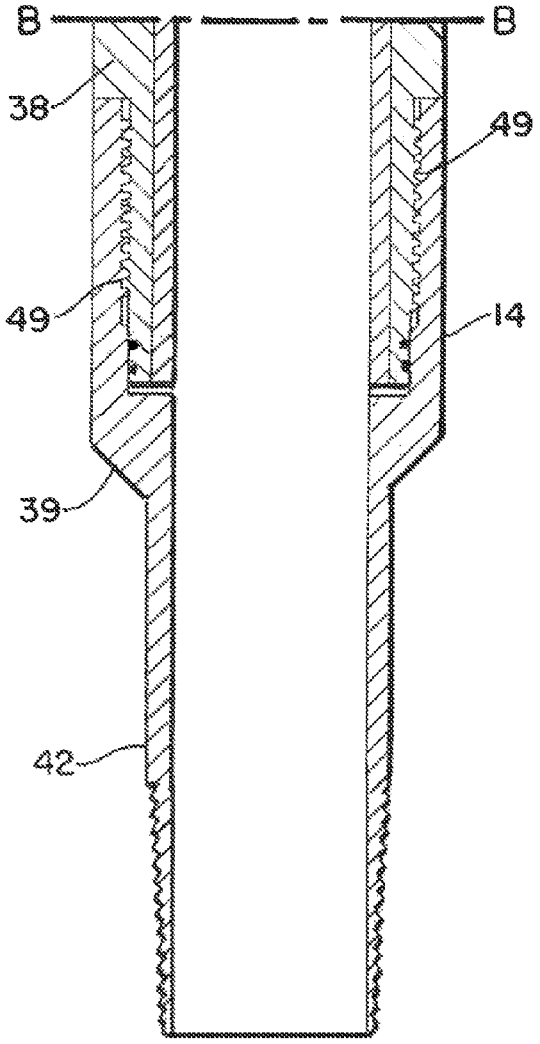
Figure 2:
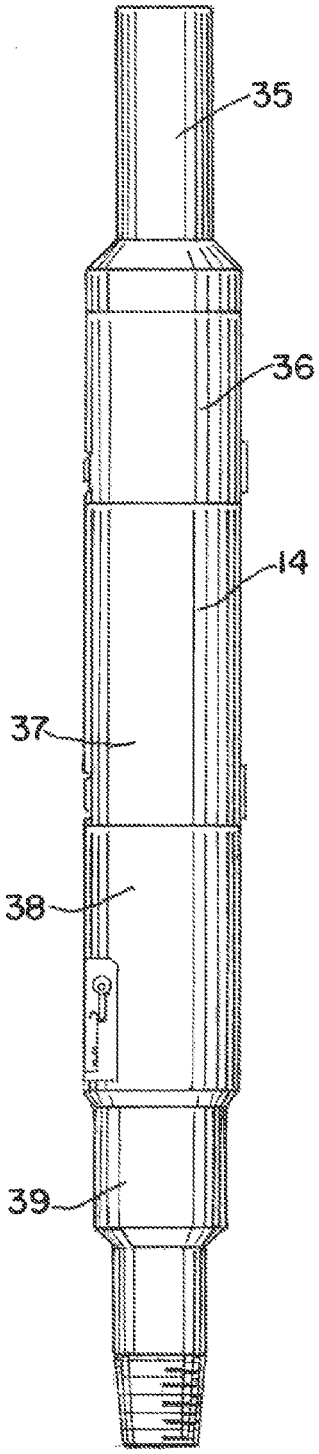
FIG. 2 is a partial elevation view of the preferred embodiment of the apparatus of the present invention.

Ball/plug dropping head tool body 14 has an upper end portion 41 and a lower end portion 42. Tool body 14 can be of multiple sections that are connected together, such as with threaded connections. In FIGS. 1A-1C, the tool body 14 includes sections 35, 36, 37, 38, 39. The section 35 is an upper section. The section 39 is a lower section.

Tool body 14 can be pre-loaded with a number of different items to be dropped as part of a cementing operation. For example, in FIGS. 1A, 1B, 1C and 12-15 there are a number of items that are contained in tool body 14. These can include a larger diameter ball or dart or a smaller diameter ball or dart.

The tool body 14 supports a plurality of valving members 43, 44. The valving members can include first valving member 43 which is an upper valving member and second valving member which is a lower valving member 44.

Threaded connections 46, 47, 48, 49 can be used for connecting the various body sections 35, 36, 37, 38, 39 together end to end as shown in FIGS. 1A, 1B, 1C. Tool body 14 upper end 41 is provided with an internally threaded portion 50 for forming a connection with tubular member 34 that depends from fitting 25 as shown in FIG. 4. A flow bore 51 extends between upper end 41 and lower end 42 of tool body 14.

Sleeve sections 52 are secured to tool body 34 within bore 51 as shown in FIGS. 1A, 1B, 1C. Sleeves or sleeve sections 52 can be generally centered within bore 51 as shown in FIGS. 1A, 1B, 1C using spacers 67 that extend along radial lines from the sections 35-39.

Each valving member 43, 44 is movable between open and closed positions. In FIGS. 1A, 1B, 1C each of the valving members 43, 44 is in a closed position. In that closed position, each valving member 43, 44 prevents downward movement of a plug, ball or dart 40. In FIG. 1A, the closed position of valving member 43 prevents downward movement of larger diameter ball 40. Similarly, in FIG. 1B, a closed position of valving member 44 prevents a downward movement of dart 40. In each instance, a ball, dart or plug 40 rests upon the outer curved surface 68 of valving member 43, as shown in the drawings.

Figure 15:
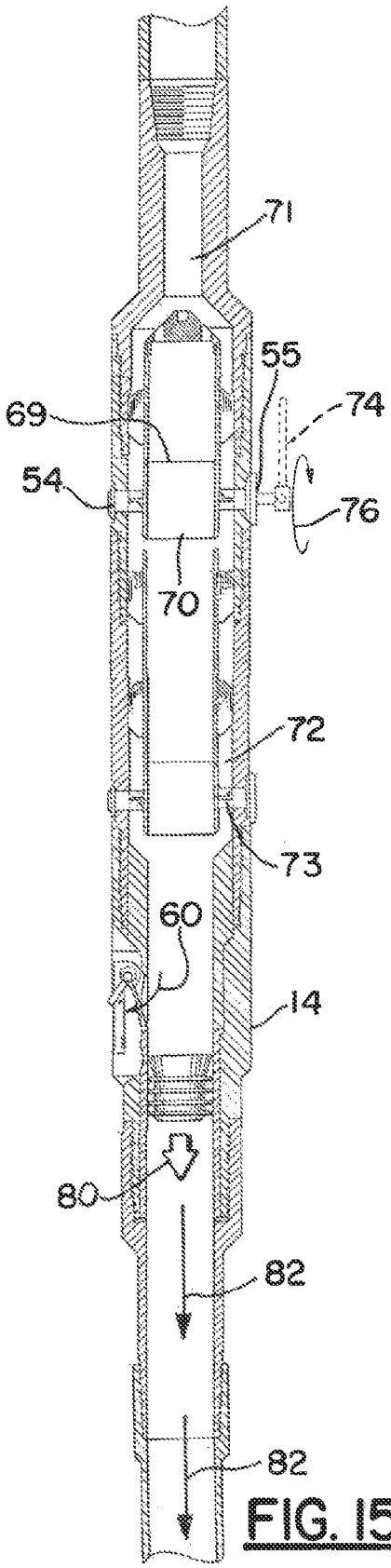
FIG. 15 is a partial sectional elevation view of the preferred embodiment of the apparatus of the present invention.

Each valving member 43, 44 provides a pair of opposed generally flat surfaces 69, 70 (see FIG. 15). The tool body 14 provides opposed openings 90 that are receptive to the generally cylindrically shaped valve stems 54, 55 that are provided on the flat sections or flat surfaces 69, 70 of each valving member 43, 44. The flat surface 69 provides valve stem 54. Openings 90 are receptive of stems 54, 55.

The flat surfaces 69, 70 enable fluid to flow in bore 51 in a position radially outwardly or externally of sleeve or sleeve section 52 by passing between the tool body sections 35, 36, 37, 38, 39 and sleeves 52. Thus, bore 51 is divided into two flow channels. These two flow channels 71, 72 include a central flow channel 71 within sleeves 52 that is generally cylindrically shaped and that aligns generally with the channel 53 of each valving member 43, 44. The second flow channel is an annular outer flow channel 72 that is positioned in between a sleeve 52 and the tool body sections 35, 36, 37, 38, 39. The channels 71, 72 can be concentric. The outer channel 72 is open when the valving members 43, 44 are in the closed positions of FIGS. 1A, 1B and 1C, wherein central flow channel 71 is closed.

When the valving members 43, 44 are rotated to an open position, fins 73 become transversely positioned with respect to the flow path of fluid flowing in channel 72 thus closing outer flow channel 72. This occurs when a valving member 43, 44 is opened for releasing a ball or dart 40.

Figure 13:
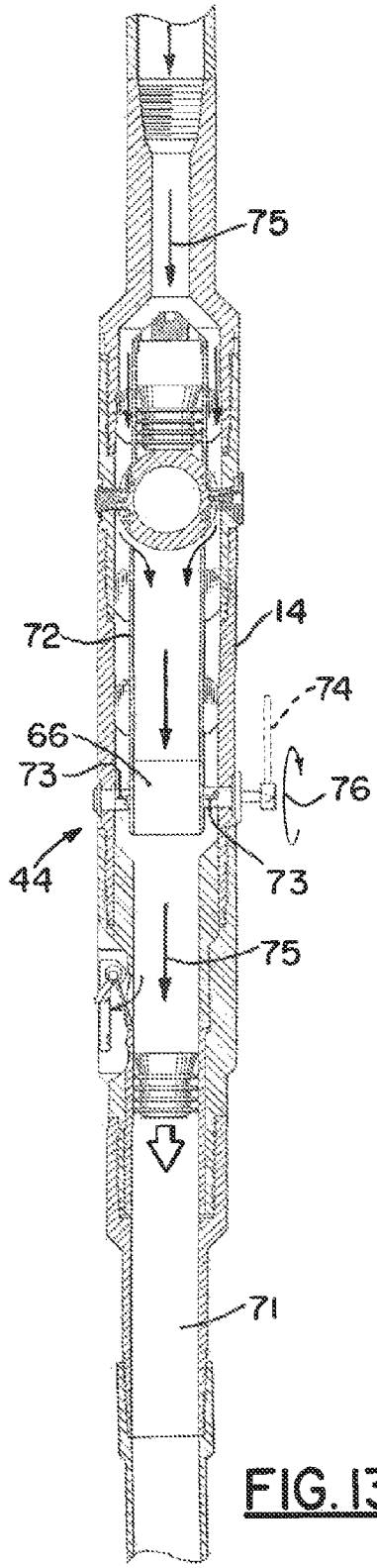
FIG. 13 is a partial sectional elevation view of the preferred embodiment of the apparatus of the present invention.
Figure 14:
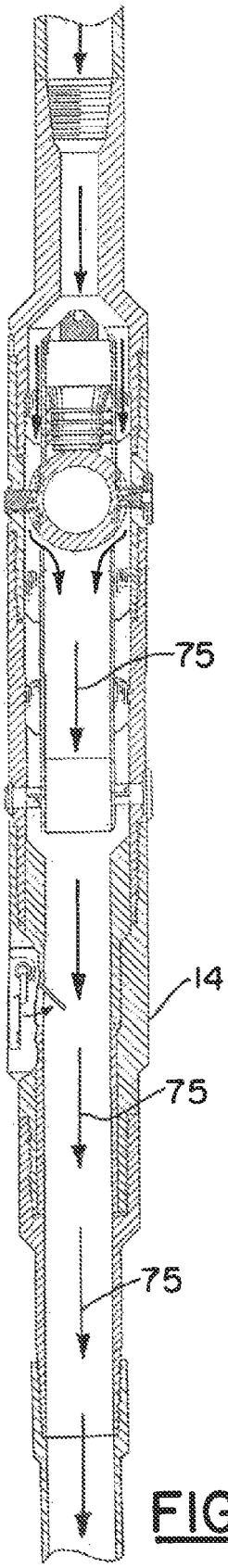
FIG. 14 is a partial sectional elevation view of the preferred embodiment of the apparatus of the present invention.

In FIG. 13, a tool 74 has been used to rotate valving member 44 in the direction of arrow 76 to an open position 66 that aligns its channel 53 with central flow channel 71 enabling a dart or ball 40 to fall downwardly via central flow channel 71. In FIG. 13, outer flow channel 72 has been closed by fins 73 that have now rotated about 90 degrees from the open position of FIGS. 1A, 1B to the closed position. Fins 73 close channel 72 in FIG. 15. It should be understood that tool 74 can also be used to rotate valving member 43 or 44 from a closed position to an open position 66 when it is desired that ball or dart 40 should drop.

With valves 43 open (see FIG. 15), channel 72 enables fluid to circulate through behind the plug or dart 40 (see FIG. 13).

In FIG. 15, second valving member 44 is opened releasing a dart 40. This second dart can be inserted behind the first plug or dart 40 that was released by valve 43. The second dart 40 can be used to push the cement 80 downwardly in the direction of arrow 82 in FIG. 15. A completion fluid or other fluid can be used to pump the second dart 40 downwardly, pushing cement ahead of it.

The ball 40 can be deformable, so that it can enter the smaller diameter section at the lower end portion 42 of tool body 14.

Sleeve 52 is preferably a sliding sleeve that drops downwardly when a valving member 43 or 44 is rotated to an open position.

When valving member 44 is rotated to the open position, the gap between sleeve 52 and valving member 43 is now a larger gap.

A sleeve 52 above a valving member 43 or 44 thus moves up and down responsive to a rotation of that valving member 43 or 44.

Indicator 56 can be attached to tool body 14 as shown in FIG. 1B. Recesses 59 on the tool body 14 enable attachment of shaft 57. The shaft 57 can be held in position using fasteners such as bolts, for example. Spring 58 can then be attached to tool body 14 at recess 59 using fasteners such as bolts. Curved arrow 60 in FIG. 15 illustrates rotation of shaft 57 for moving arm 61 between the extended position of FIG. 1B and the retracted position of FIG. 15. Arm 61 extends through slot 62 in the extended position of FIG. 1B.

The following is a list of parts and materials suitable for use in the present invention.

PARTS LIST

| Part Number | Description |
|---|---|
| 10 | oil well drilling system |
| 11 | drilling platform |
| 12 | derrick |
| 13 | draw works/lift |
| 14 | tool body |
| 15 | module |
| 16 | casing joint |
| 17 | casing string |
| 18 | casing running tool |
| 19 | upper end/box connection |
| 20 | lower end/pin connection |
| 21 | upper end/box connection |
| 22 | lower end/pin connection |
| 23 | valve |
| 24 | handle |
| 25 | fitting |
| 26 | inlet flow line |
| 27 | valve |

-continued

PARTS LIST

| Part Number | Description |
|---|---|
| 28 | handle |
| 29 | arrow |
| 30 | flow line |
| 31 | arm |
| 32 | slips |
| 33 | platform deck |
| 34 | short joint/sub |
| 35 | section |
| 36 | section |
| 37 | section |
| 38 | section |
| 39 | section |
| 40 | dart |
| 41 | upper end |
| 42 | lower end |
| 43 | first valving member |
| 44 | second valving member |
| 46 | threaded connection |
| 47 | threaded connection |
| 48 | threaded connection |
| 49 | threaded connection |
| 50 | threaded portion |
| 51 | flow bore |
| 52 | sleeve section |
| 53 | channel |
| 54 | stem |
| 55 | stem |
| 56 | indicator |
| 57 | shaft |
| 58 | spring |
| 59 | recess |
| 60 | arrow |
| 61 | arm |
| 62 | slot |
| 63 | short joint/sub |
| 64 | long joint/sub |
| 66 | opening position |
| 67 | spacer |
| 68 | outer curved surface |
| 69 | flat surface |
| 70 | flat surface |
| 71 | central flow channel |
| 72 | outer flow channel |
| 73 | fin |
| 74 | tool |
| 75 | arrow |
| 76 | arrow |
| 80 | cement |
| 82 | arrow |
| 90 | opening |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A ball and plug dropping head for use in sequentially dropping one or more balls and plugs into a well tubing, comprising:

a) a top drive having a lower end portion;

b) a tool body comprised of a plurality of modules, each module connected to another module with a threaded connection, the tool body having an inlet at its upper end adapted to be fluidly connected in line with the lower end of the top drive, an outlet generally aligned with the inlet;

c) a main inner flow channel that connects the inlet and the outlet, and an outer channel;

d) the modules including some modules that are not valving members and a plurality of valving members spaced between the inlet and the outlet, each valving member having a ball portion with a flow bore, and being movable between open and closed positions;

e) the outer channel enabling fluid to bypass a said valving member when the valving member is in the closed position, said outer channel having a curvature;

f) at least one of the valving members having a cross section that, in the open position, does not valve fluid flow in the main flow channel;

g) wherein fluid flow flows around the valving member via the outer channel when the ball portion is in the closed position and through the valving member and inner channel when the valve is in the open position;

h) wherein each valving member is configured to support a ball or plug when closed;

I) wherein in the open position each valve flow bore permits a ball or plug to pass therethrough, and circulating fluid to pass downwardly therethrough when neither a ball nor plug is in the valve flow bore; and j) the valving member having an outer portion that valves the outer channel, an edge of the outer portion having the same curvature as the outer channel.

2. The ball and plug dropping head of claim 1, wherein at least one valve has a pair of opposed, generally flat surfaces.

3. The ball and plug dropping head of claim 1, wherein at least one valving member has a valve opening that enables passage of a plug of a diameter of 6.5 inches.

4. The ball and plug dropping head of claim 1, wherein at least one valving member in the closed position has a generally cylindrically shaped cross section.

5. The ball and plug dropping head of claim 1, wherein at least one valving member in the closed position has a generally rectangular shaped cross section.

6. The ball and plug dropping head of claim 1, wherein the tool body has a working tension of two million pounds.

7. The ball and plug dropping head of claim 1, wherein the tool body has an internal working pressure of 15,000 psi.

8. The ball and plug dropping head of claim 1, wherein the tool body has a working torque of 50,000 foot pounds.

9. The ball and plug dropping head of claim 8, wherein the tool body has a working torque of 50,000 foot pounds in either of two rotational directions.

10. The ball and plug dropping head of claim 1, wherein there are multiple valving members that enable fluid flow around the valving member when the valving member is closed.

11. A method of sequentially dropping one or more balls, darts or plugs into an oil and gas well tubing, comprising the steps of:

a) providing a multi-section tool body having an inlet at its upper end adapted to be fluidly connected in line with the lower end of a top drive, an outlet generally aligned with the inlet, a main flow channel that connects the inlet and the outlet and a plurality of valving members spaced between the inlet and the outlet, each valving member having a ball member with a flow bore, and being movable between open and closed positions, the tool body including one or more sections that are not valving members;

b) supporting the tool body with a top drive;

c) enabling fluid to bypass the valving members via an outer channel having an outer channel wall with a curvature when a valving member is in the closed position;

d) preventing fluid flow in the flow bore when a valving member is in a closed position;

e) enabling fluid flow in the main flow channel when the valving member is in the open position;

f) supporting a ball or plug with a valving member only when the valving member is closed;

g) enabling flow during step "c" with one or more outer channel valve members that each have a curvature that is the same curvature as the outer channel curvature.

12. The method of claim 11, wherein at least one valve has a pair of opposed, generally flat surfaces.

13. The method of claim 11, wherein at least one valving member has a valve opening that enables passage of a plug of a diameter of 6.5 inches.

14. The method of claim 11, wherein at least one valving member in the closed position has a generally cylindrically shaped cross section.

15. The method of claim 11, wherein at least one valving member in the closed position has a generally rectangular shaped cross section.

16. The method of claim 11, wherein the tool body has a working tension of two million pounds.

17. The method of claim 11, wherein the tool body has an internal working pressure of 15,000 psi.

18. The method of claim 11, wherein the tool body has a working torque of 50,000 foot pounds.

19. The method of claim 18, wherein the tool body has a working torque of 50,000 foot pounds in either of two rotational directions.

20. The method of claim 11, further comprising enabling fluid to flow around the valving member when the valving member is closed.

21. A method of transmitting cement into an oil and gas well having an open hole well bore at least partially occupied by a casing string, comprising the steps of:

a) providing a top drive supported by a lift;

b) attaching a tool body having multiple sections to the casing string after step "a", the tool body including multiple valving members, and one or more sections that are connected to a valving member but that are not valving members wherein the tool body enables fluid circulation through or around a said valving member that controls dispensing of a plug;

c) wherein in step "b" circulation is enabled before or after dropping a plug, the tool body including one or more ball valving members that valve a central passageway and one or more outer channel valving members attached to the ball valving member for valving flow in an outer channel with a curvature and around the central passageway each said outer channel valving member having a curved surface that has the same curvature as the curvature of the outer channel;

d) rotating the casing string after step "c" while circulating a well fluid into the well bore via the casing string annulus;

e) circulating fluid into the well after step "c";

f) releasing the plug into the well after step "d"; and g) transmitting a cementitious material into the well bore after step "f".

* * * * *